United States Patent [19]

Henderson et al.

[11] 4,246,586

[45] Jan. 20, 1981

[54] RADIO ANTENNAE

[75] Inventors: Ann Henderson, Wantage; James R. James, Swindon, both of England

[73] Assignee: National Research Development Corporation, London, England

[21] Appl. No.: 3,881

[22] Filed: Dec. 20, 1978

[30] Foreign Application Priority Data

Dec. 20, 1977 [GB] United Kingdom ..... 53039/77

[51] Int. Cl.[3] ..... H01Q 1/40

[52] U.S. Cl. ..... 343/873

[58] Field of Search ..... 343/787, 807, 873

[56] References Cited

U.S. PATENT DOCUMENTS

| | | | |
|---|---|---|---|
| 3,302,208 | 1/1967 | Hendrickson . | |
| 3,310,807 | 3/1967 | Kofoid . | |
| 3,931,625 | 1/1976 | Chiron et al. | 343/787 |

FOREIGN PATENT DOCUMENTS

| | | |
|---|---|---|
| 592763 | 9/1947 | United Kingdom . |
| 791585 | 3/1958 | United Kingdom . |
| 1282293 | 7/1972 | United Kingdom . |

*Primary Examiner*—Theodore M. Blum

*Attorney, Agent, or Firm*—Cushman, Darby & Cushman

[57] ABSTRACT

This invention relates to radio antennae, and in particular to dielectric-clad antennae of the kind comprising a length of conductor the electrical length of which is effectively increased by a cladding of dielectric material. The disclosure describes how the physical height of an antenna, typically an HF or VHF wire monopole antenna can be reduced in relation to its electrical length by means of a thin cladding of dielectric material having a relative magnetic permeability substantially greater than unity, e.g. ferrite. By selecting a material having a relative magnetic permeability substantially greater than its relative dielectric permittivity, a given reduction in antenna height can be achieved with a much thinner cladding than can be achieved using conventional materials.

3 Claims, 2 Drawing Figures

RADIO ANTENNAE

This invention relates to radio antennae, particularly radio antennae for use in the HF and VHF frequency bands.

Portable or vehicle-mounted radio sets, such as walkie-talkies, operating in the HF and VHF frequency bands commonly employ quarter-wave monopole whip-type antennae which, although providing satisfactory electrical performance, can be unwieldy in certain situations due to their awkward length, particularly in the HF band. It is now known practice to reduce the physical length for a given operating frequency, of quarter-wave monopoles by cladding the conductor with a dielectric material. However, the thickness of purely dielectric cladding required to achieve a given proportional reduction in the physical length of the antenna (with respect to its electrical length) increases with decreasing frequency until, in the frequency range below 100 MHz such dielectric-clad antennae become too unwieldy for most applications.

It has also been shown (A. Madani et al, "Antenne Doublet Cylindrique Noyee dans une Gaine de Ferrite, Cylindrique et de Meme Axe", Annales des Telecommunications 1972 , 27pp 430–449 that the electrical length of such an antenna in relation to its physical height (height reduction factor), can also be reduced using cladding materials, eg errites, having both dielectric and magnetic properties. This paper describes a variety of doublet antenna structures each comprising a length of conductor clad in a cylindrical coating of ferrite material selected to have a relative dielectric permittivity and relative magnetic permeability possible. The antennae are designed for operation at various frequencies ranging from 250 to 740 MHz.

The theoretical and experimental results of the above paper teach that, to achieve the best height reduction factor, the thickness of the cladding material both in relation to the thickness of the conductor and in relation to the height or length of the conductor should be as large as possible. This conclusion derives from the finding that for a given ratio of cladding thickness to conductor thickness, the height reduction factor achieved decreases with increasing height because the field lines become less and less confined within the cladding.

Again however, while the thicknesses of cladding material described provide antennae of reasonable dimensions at frequencies above 200 MHz when extended to the frequency range below 100 MHz the cladding thicknesses required would be too unweildy for most applications.

According to the present invention, a radio antenna comprises a length of conductor of thickness *2a* electromagnetically coupled with a cladding of dielectric material having an average thickness t and a relative magnetic permeability substantially greater than unity, and in which the ratio N of the electrical length of the clad conductor to that of the unclad conductor in free space at the operating frequency is equal to greater than 350 $(t+a)/\lambda_o$ where $\lambda_o$ is the free space wavelength at the operating frequency.

Although it is envisaged that in most applications, the thickness of the cladding material will be uniform, the term 'average thickness' anticipates applications in which the cladding may be non-uniform, or possibly non-continuous, and is intended to mean substantially the thickness that the same volume of cladding material would provide if distributed uniformly over the length of conductor. However, where the thickness of the conductor varies along its length, the thickness of the cladding may vary accordingly to maintain a fixed ratio between the cladding thickness and the conductor thickness.

The invention resides in the realisation by the inventors that a given reduction in the physical size of an antenna, in relation to its frequency characteristics, can be achieved with much smaller thicknesses of magnetic cladding materials than with purely dielectric materials.

This phenomenon has been noticed by the inventors in a comparison of theoretical plots of height reduction factor N against the ratio of $(t+a)/\lambda_o$ for a given $U_r/\epsilon_r$ ratios, but with the same $\epsilon_r.U_r$ product.

The plots show that as the thickness of the cladding material increases, ie $(t+a)/\lambda_o$ increases, the height reduction factors achieved with each of the different materials tend towards the same theoretical maximum value of $\sqrt{\epsilon_r.U_r}$. However for decreasing, values of the cladding thickness, the height reduction factors achieved by purely dielectric materials was noted to unexpectedly decrease more rapidly than materials having both dielectric and magnetic properties, and that the higher the ratio $U_r/\epsilon_r$, the slower the decline in the height reduction factor.

For materials with $U_r >> \epsilon_r$, the abovementioned graphical plot of N versus $(t+a)/\lambda_o$ rises rapidly towards a threshold value or 'knee' in the curve approaching the maximum $\sqrt{\epsilon_r U_r}$, far more rapidly than materials having lower $U_r/\epsilon_r$ ratios, and these results have been borne out experimentally. Beyond the knee, the height reduction factor N increases at a much slower rate with increasing cladding thickness, or more accurately, with increasing values of $(t+a)/\lambda_o$. Thus, although the use of magnetic cladding materials, eg ferrites, in wire antennae has previously been suggested, this phenomenon has never hitherto been appreciated, and the invention enables the design of more compact antennae than has previously been possible using conventional purely dielectric cladding techniques.

Preferably therefore, the cladding material has a relative magnetic permeability substantially greater than its relative dielectric permittivity, and the ratio $(t+a)/\lambda_o$ for the antenna structure lies on or below the knee in the graphical plot of N against $(t+a)/\lambda_o$.

The invention may be applied to any suitable form of antenna in which it is required to reduce the overall physical size for a given frequency characteristic. The clad length of conductor may form only part of the antenna. Futhermore, the antenna may include more than one such clad length of conductor. Examples of antenna to which the invention may be applied include monopoles, dipoles, YAGI antennae, wire grid wideband structure, and conical or biconical antennae.

In most applications, the length of conductor will be in the form of a wire or rod (the greater the ratio of the cladding thickness t to the conductor thickness, the greater will be the reduction in size achieved) the cladding then conveniently being in the form of a cylindrical sleeve. For example in the case of a monopole antenna, the length of conductor simply comprises a single length of wire or rod enclosed in a cylindrical cladding. In addition, the antenna may advantageously include an additional unclad length of conductor, continuous with the clad length of conductor, to permit trimming of the resonant frequency for example.

The invention will now be further described by way of example only with reference to the accompanying drawings, of which:

Figure 1:
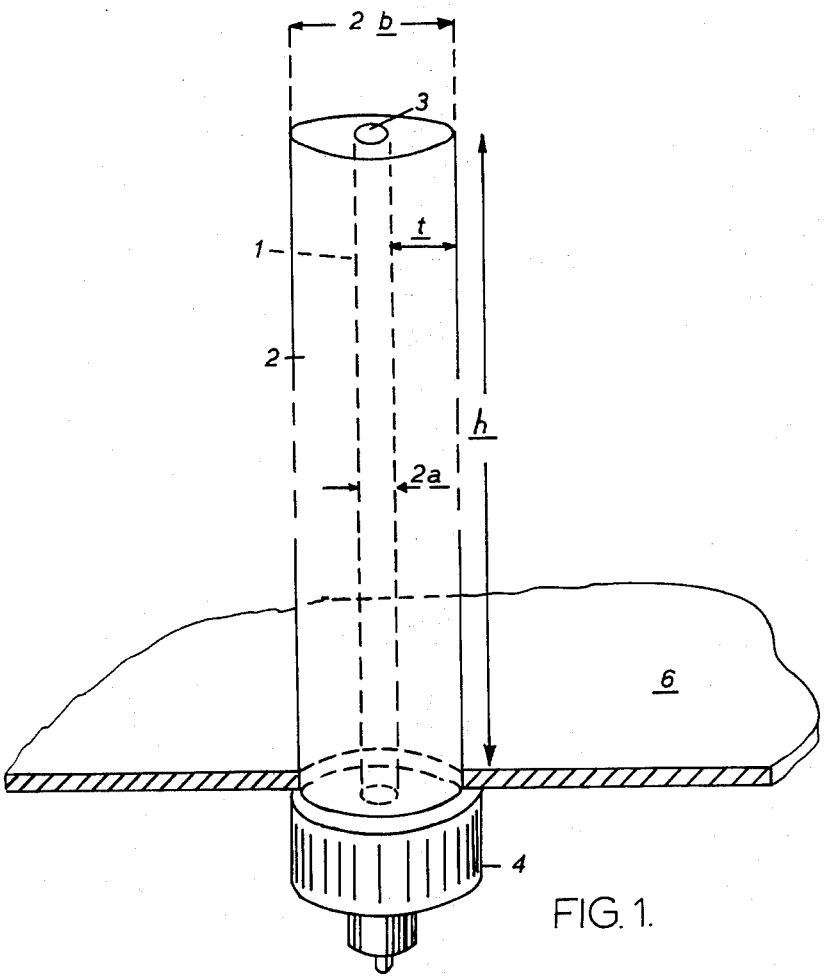
FIG. 1 shows a radio antenna in accordance with the present invention.

Referring to the drawings, the antenna shown in FIG. 1 is a narrow-band quarter-wave resonant monopole FM radio antenna comprising a length h of conductor 1 in the form of a copper wire or rod of diameter 2*a* clad along its entire length in a coating 2, thickness t of suitable ferrite material. The cladding 2 immediately surrounds the conductor such that the external radius b of the antenna is (t+a). One end 3 of the conductor is open circuit while the other end is connected to the central electrode of a coaxial connector 4 the ground conductor of which is connected to a metallic ground plane 6 on which the antenna is vertically mounted.

The electrical length of the antenna approximates to $\lambda_o/4$ where $\lambda_o$ is the free space wavelength at the resonant frequency of the antenna, but the physical length or height h of the antenna is shorter than this by a factor $N \sim \lambda_o/4$ h referred to as the height reduction factor which is the ratio of the electrical length of the clad conductor to that of the unclad conductor in free space, at the operating frequency of the antenna. The best height reduction factor N theoretically achievable is given by the expression.

$$N = \sqrt{\epsilon_r \cdot \mu_r} \tag{1}$$

where $\epsilon_r$ and $\mu_r$ are the relative permittivity and relative permeability respectively of the cladding material.

Figure 2:
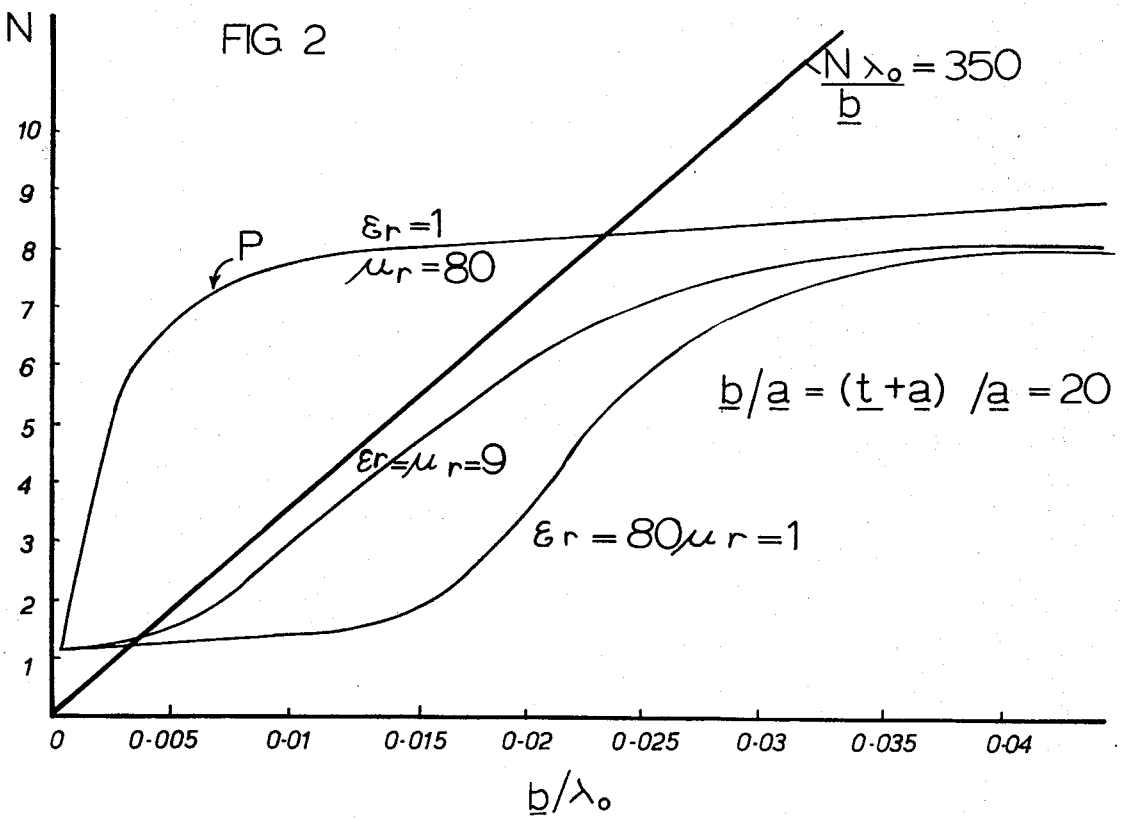
FIG. 2 shows graphical plots of antenna height reduction versus the ratio of the antenna radius to the freespace wavelength at the resonant frequency for cladding materials having different magnetic and dielectric properties.

FIG. 2 shows, for a monopole resonant at any given frequency and in which b/a=20, how the reduction factor N that can be achieved varies with the thickness of the cladding material for materials having the same $\epsilon_r\mu_r$ product of $\approx 80$, but different values of $\epsilon_r$ and $\mu_r$.

It will be seen that where the thickness t of the cladding is comparatively high in relation to the free space wavelength $\lambda_o$ (in this case above $b/\lambda_o=0.035$), the three curves tend to the same value of N (for axial mode propagation) corresponding closely to the value predicted by equation (1). However, as the thickness t of the cladding decreases in relation to the free space wavelength $\lambda_o$ the height reduction factors achievable using the different materials varies considerably and it is this phenomenon which the invention seeks to exploit.

For cladding materials in which $\mu_r > \epsilon_r$, there is a 'knee' (P) in the N versus $b/\lambda_o$ curve, and the invention is exploited to maximum effect in antennae using a cladding material with a high value of $\mu_r/\epsilon_r$ and designed to have a value of $b/\lambda_o$ below the value determined by the 'knee' in the curve. For values of $b/\lambda_o$ above this 'knee', the rate at which the height reduction factor N increases with increasing thickness of cladding material is reduced, and so a proportionately greater increase in the thickness of cladding material is required to achieve a given increase in the height reduction factor.

Although the greatest advantages are achieved using antenna designed in accordance with the region of the N versus $b/\lambda_o$ curve lying below the knee, the invention is not confined to such antennae. The specified limit of $N\lambda_o/(t+a) \geqq 350$ effectively defines a practical lower limit for the height reduction factor N achieved in accordance with the invention for a given thickness of cladding material, or more precisely, for a given value of $(t+a)/\lambda_o$. Below this limit, it has been found that the thickness of cladding material required to achieve a given height reduction factor would result in too bulky an antenna for most applications.

As mentioned above, the greatest advantages in terms of height reduction are achieved using cladding materials having high values of $\mu_r/\epsilon_r$, and cladding thicknesses corresponding to values of $b/\lambda_o$ smaller than that at which the 'knee' in the N versus $b/\lambda_o$ curve for that material occurs. The 'knee' is most pronounced for materials in which $\mu_r >> \epsilon_r$, and for such materials the equation for the N versus $b/\lambda_o$ curve for the monopole described approximates to:

$$b/\lambda_o = \frac{e^{-z}}{2\pi\sqrt{N^2-1}} \tag{2}$$

$$\text{where } z = \frac{(\epsilon_r \cdot U_r - N^2)\log_e(b/a)}{(N^2-1),\ \epsilon_r}$$

for small values of $b/\lambda_o$ up to that at which the 'knee' occurs.

It can be shown from the equation (2) that by making b/a as large as possible, ie by making the conductor as thin as possible, a greater height reduction factor can be achieved for a given external radius b=t+a.

A further advantage arising from the use of magnetic cladding materials in accordance with the present invention is that in many cases the presence of the magnetic material in the cladding produces a higher input impedance at resonance than that achieved for corresponding purely dielectric-clad antennae. This can be of important practical significance because the low antenna input impedances associated with dielectric clad antenna do create difficulties in matching with associated circuitry. The input impedance can be further increased by feeding the monopole at some distance from its base, ie intermediate its two ends.

While the invention can in principle be applied to antennae operating at any frequency in the HF or VHF bands, the actual frequency range to which it can at present be applied is largely dependent on the availability of suitable materials having the required low loss magnetic properties. The most suitable materials currently available are ferrites, but the lack of existing low loss ferrite materials at high frequencies places an upper limit of about 100 MHz for most applications. However, this could be considerably extended if suitable low loss high frequency magnetic materials are developed. At the lower end of the HF band, ie below about 5 MHz, the practical limit is determined by the required thickness of the magnetic cladding material, which, using existing ferrite materials, although considerably smaller than that required for a dielectric-clad antennae, would still probably make antennae in accordance with the invention too bulky or unwieldy for most applications at these frequencies.

The cladding may be of any suitable form, such as a plurality of toroids strung along the conductor like a string of beads; or it may comprise a coating formed in situ. Additional support and protection may be provided in the form of a sheathing of insulating material. The entire length of the monopole conductor need not be enclosed by the cladding material; one end may for example remain bare to permit final trimming of the antenna to a desired resonant frequency.

As presently envisaged, the primary application of the invention is to narrow-band monopole antennae of the kind described above operating in the HF and VHF frequency bands, although it may also prove advantageous in its application to other types of antennae, for example dipoles, YAGI antennae, wire grid wideband structures and even conical or biconical antennae. In any such application of the invention the antennae conductor or conductors, may be fully, or only partially clad in accordance with the invention with magnetic cladding material; or a combination of magnetic and purely dielectric cladding materials may be used. Furthermore, the cladding may comprise a plurality of layers of different cladding materials having different electrical properties.

The invention is not restricted to antennae in which the conductor or conductors are in the form of a rod or wire of uniform thickness, but extends to applications in which the conductors are of any appropriate form, suitably clad in accordance with the invention, to provide the specified reduction in their physical size.

We claim:

1. A radio antenna comprising a length of conductor of thickness *2a* electromagnetically coupled with a cladding of dielectric material having an average thickness t and a relative magnetic permeability substantially greater than unity and substantially greater than the relative dielectric permittivity thereof, wherein the ratio N of the electrical length of the clad conductor to that of a corresponding unclad conductor in free space at the operating frequency is equal to or greater than $350\,(t+a)/\lambda o$ where $\lambda o$ is the free space wavelength at the operating frequency, and wherein the value of $(t+a)/\lambda o$ for the antenna lies on or near the knee in the graphical plot of N versus $(t+a)/\lambda o$ for a fixed ratio of $(t+a)/a$ using the same cladding material.

2. A radio antenna as claimed in claim 1, wherein the conductor is a rod or wire and the cladding material is in the form of a uniform coaxial cylindrical coating.

3. A radio antenna as claimed in claim 2, wherein the antenna is a monopole antenna the electrical length of which corresponds to a quarter of a wavelength in free space at the operating frequency.

* * * * *

UNITED STATES PATENT AND TRADEMARK OFFICE

CERTIFICATE OF CORRECTION

PATENT NO. : 4,246,586

DATED : January 20, 1981

INVENTOR(S) : Ann Henderson et al.

It is certified that error appears in the above—identified patent and that said Letters Patent is hereby corrected as shown below:

Column 1, line 34 should read:

--permittivity $\varepsilon_r$ and relative magnetic permeability $\mu_r$ as large as possible and as nearly equal as possi[ble]--

Signed and Sealed this

*Twenty-first* Day of *July 1981*

[SEAL]

*Attest:*

GERALD J. MOSSINGHOFF

*Attesting Officer*

*Commissioner of Patents and Trademarks*